US010329874B2

(12) United States Patent
Wright et al.

(10) Patent No.: US 10,329,874 B2
(45) Date of Patent: Jun. 25, 2019

(54) SAFETY VALVE HANDLING APPARATUS FOR A WELL OPERATION RIG

(71) Applicant: PROSTAR MANUFACTURING INC., Okotoks (CA)

(72) Inventors: Adam Wright, Calgary (CA); Daniel Harvard Kusler, Foothills (CA)

(73) Assignee: PROSTAR ENERGY TECHNOLOGIES (USA) LLC, Leduc (CA)

( * ) Notice: Subject to any disclaimer, the term of this patent is extended or adjusted under 35 U.S.C. 154(b) by 64 days.

(21) Appl. No.: 15/383,834

(22) Filed: Dec. 19, 2016

(65) Prior Publication Data

US 2017/0241234 A1 Aug. 24, 2017

Related U.S. Application Data

(60) Provisional application No. 62/296,719, filed on Feb. 18, 2016.

(51) Int. Cl.

| | |
|---|---|
| ***E21B 15/00*** | (2006.01) |
| ***E21B 19/02*** | (2006.01) |
| ***E21B 19/16*** | (2006.01) |
| ***E21B 21/10*** | (2006.01) |
| ***E21B 34/00*** | (2006.01) |

(52) U.S. Cl.

CPC ..... *E21B 34/00* (2013.01); *E21B 15/00* (2013.01); *E21B 19/02* (2013.01); *E21B 19/16* (2013.01); *E21B 21/10* (2013.01)

(58) Field of Classification Search

CPC ..... E21B 15/00; E21B 34/00; E21B 21/10; E21B 21/106; E21B 41/0031

See application file for complete search history.

(56) References Cited

U.S. PATENT DOCUMENTS

| | | | | |
|---|---|---|---|---|
| 2,976,943 | A * | 3/1961 | Curtis | E21B 19/16 173/164 |
| 6,189,620 | B1 * | 2/2001 | McDowell | E21B 19/16 166/379 |
| 2013/0255446 | A1 * | 10/2013 | Taggart | E21B 19/161 81/57.11 |
| 2017/0175463 | A1 * | 6/2017 | Ritter | E21B 19/07 |

* cited by examiner

*Primary Examiner* — James G Sayre

(74) *Attorney, Agent, or Firm* — Christensen O'Connor Johnson Kindness PLLC

(57) ABSTRACT

A safety valve handling apparatus for a well operation rig includes: a mounting structure for connection to the rig; a clamp for engaging a safety valve and configured to permit rotation of the safety valve within the clamp while the safety valve remains engaged by the clamp; and an arm connected between the mounting structure and the clamp, the arm being movable and adjustable to permit movement of the clamp relative to the mounting structure. The safety valve handling apparatus can be used for controlled safety valve handling on a well operation rig, even one oriented for a slanted operation.

14 Claims, 3 Drawing Sheets

SAFETY VALVE HANDLING APPARATUS FOR A WELL OPERATION RIG

FIELD

The invention relates to a well operation rig apparatus and in particular a safety valve apparatus.

BACKGROUND

Wellbore operations employ pipe strings, sometimes called drill, production or work strings, each used for drilling and/or servicing. The pipe string can comprise a bottom hole assembly such as, when drilling, a drill bit attached to sections of drill pipe. As the well is drilled or serviced, additional sections of drill pipe are added to the pipe string to extend its length until the bottom hole assembly is deep enough to reach a depth of interest. Sections of pipe are joined together using threaded connections on the pipe, often referred to as "pin" and "box" connections, where the pin of one section of pipe is threaded into the box of an adjoining section of pipe. When the pipe string is removed from the wellbore, the sections of pipe can be removed from the pipe string by unthreading the connections and setting aside a pipe section. Generally, one section of pipe is secured protruding from the rig floor. This section is often referred to as the stump. The stump may have an open inner diameter that is in communication with the bottom hole assembly in the depths of the well.

Sometimes during operations, it is necessary to plug the inner diameter of the stump. For example, a plug may be installed to stop fluids from passing up through the string and from being released at the stump. As another example, a plug may be installed if there is a stoppage in the drilling or servicing operation.

The plug used for installation in the stump is called a safety valve or a stabbing valve. The safety valve has a threaded connection that threads into the stump's exposed threaded connection and an integral valve that can be opened or closed to open the inner diameter of the pipe string at the stump. The safety valve must be kept at the ready. Typically, the safety valve is set on the rig work floor and must be manually lifted into place or the safety valve is suspended from a tugger winch and must be hoisted into position if needed.

With the introduction of slant rigs, difficulties have arisen in the use of safety valves.

SUMMARY

In accordance with a broad aspect of the present invention, there is provided a safety valve handling apparatus for a rig, the apparatus comprising: a mounting structure for connection to the rig; a clamp for engaging a safety valve and configured to permit rotation of the safety valve within the clamp while the safety valve remains engaged by the clamp; and an arm connected between the mounting structure and the clamp, the arm being movable and adjustable to permit movement of the clamp relative to the mounting structure.

In accordance with another broad aspect of the present invention, there is provided a well operation rig comprising: a mast; a safety valve for securing in a stump secured by the well operation rig; a safety valve apparatus for installing the safety valve on the mast, the safety valve comprising: a mounting structure for connecting the apparatus to mast; a clamp for engaging the safety valve and configured to permit rotation of the safety valve within the clamp while the safety valve remains engaged by the clamp; and an arm connected between the mounting structure and the clamp, the arm being movable and adjustable to permit movement of the clamp relative to the mounting structure.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly, the drawings and detailed description are to be regarded as illustrative in nature and not as restrictive.

DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope.

In the drawings.

DETAILED DESCRIPTION

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
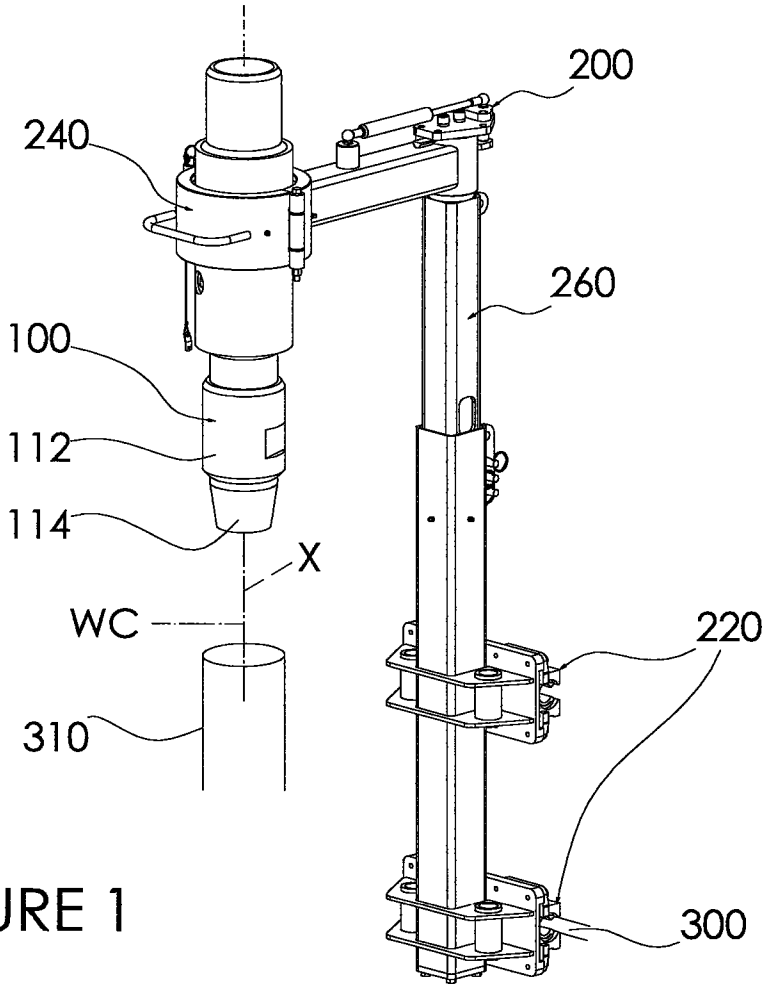
FIG. 1 is a front perspective view of a safety valve handling apparatus holding a safety valve.
Figure 2:
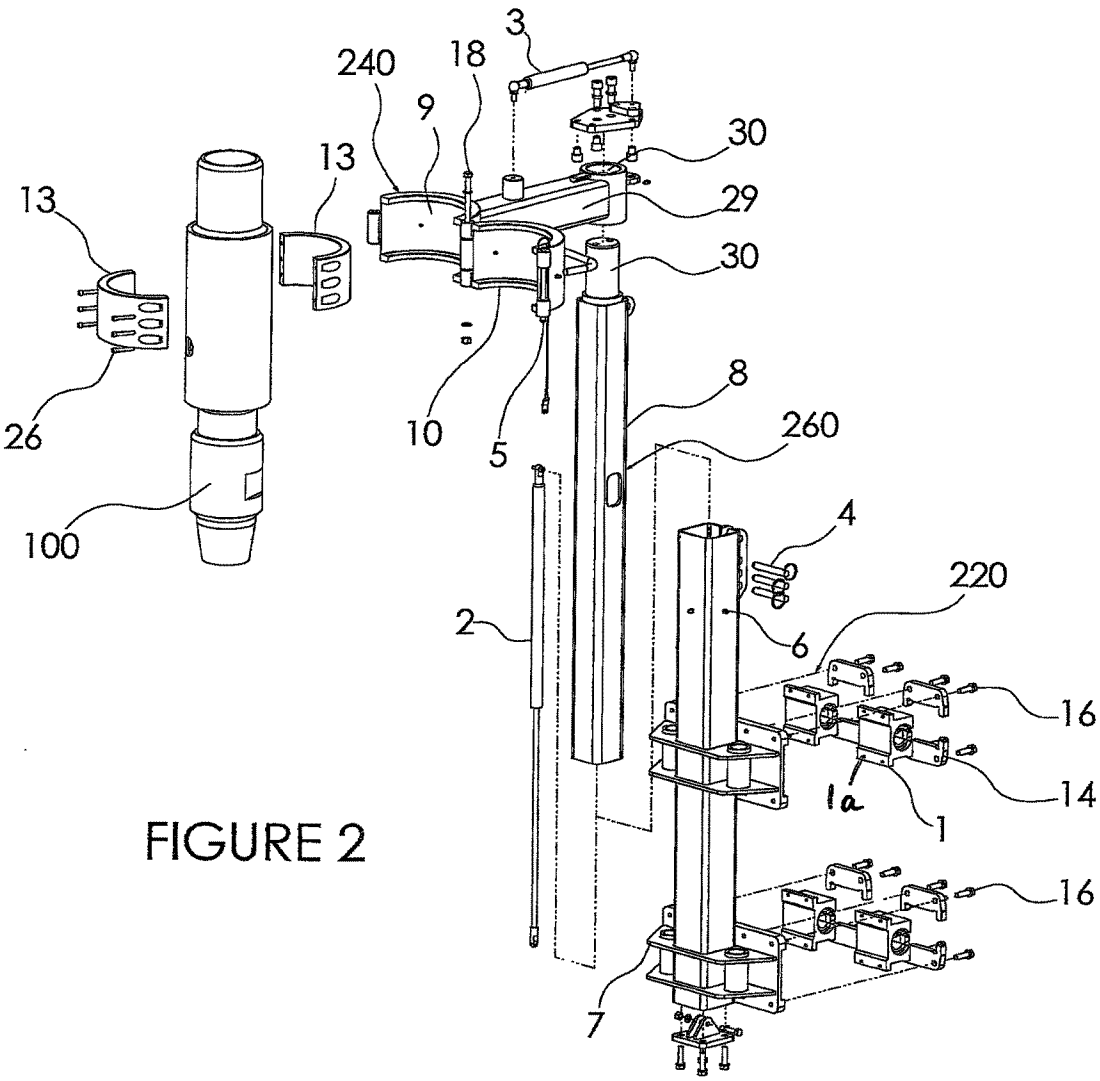
FIG. 2 is an exploded view of the of the safety valve handling apparatus of FIG. 1.

Referring to FIG. 1, a safety valve 100 is shown being supported by a safety valve handling apparatus 200.

A safety valve may take various configurations but generally includes a body with a generally cylindrical outer surface 112 about a long axis x and a lower end with a threaded connection 114 sized and configured to thread into the threaded connection used to connect one pipe section to the next. The threaded connection on the safety valve is most likely a pin, as shown, configured to thread into a box.

Safety valve apparatus 200 holds safety valve 100 adjacent the rig's 300 mast height axis which aligns with well center WC, where the stump 310 emerges from the rig floor. As such, apparatus 200 supports valve 100 in a position ready to be installed.

Apparatus 200 is configured to:

i. be mountable on the rig structure adjacent well center;

ii. hold safety valve 100 while permitting rotation of it about its long axis x. As such, the safety valve can be threaded into a stump while remaining secured to the rig; and/or iii. be movable and adjustable to allow long axis x of safety valve 100 to be moved into and out of alignment with well center while both the apparatus and safety valve remain secured to the rig.

FIGS. 1 to 4 show one embodiment of safety valve apparatus 200.

In the illustrated embodiment, safety valve apparatus 200 includes a mounting structure 220, a clamp 240 for engaging the safety valve apparatus and a movable arm 260 connected at one end to the mounting structure 220 and connected at the other end to the clamp.

Mounting structure 220 is configured to secure arm 260 and thereby safety valve 100 in a position on the rig. Mounting structure 220 may be permanent or releasable and may be configured in many possible ways. In one embodiment, structure 220 includes brackets 1, 7, 14 and fasteners 16 for attachment to a portion of the rig. In the illustrated embodiment, the brackets 1, 14 are intended to work with a frame that includes a pair of cylindrical mounting rails that fit within the cylindrical bores 1*a* in brackets 1. However, other bracket configurations are possible.

Mounting structure 220 mounts the base of arm 260 in a fixed position, for example, parallel to the mast height axis. Structure 220 moves with the rig such that if the rig is vertical the mounting structure is vertical. If the rig WC is on a slant the mounting structure is on a similar slant. The mounting structure moves the arm accordingly with the rig.

Arm 260 is adjustable with respect to both height and angular extension such that the position of the clamp 240, which is on the upper end of arm, can be adjustable.

Arm 260 includes main mount tube including an outer mount tube 6 and an inner support tube 8. Together tube 6 and 8 provide for vertical movement and adjustment of the clamp. In particular, tube 6 can telescopically slide relative to, for example from within, tube 8 to adjust for height of the clamp relative to the brackets 1, 7.

Figure 4:
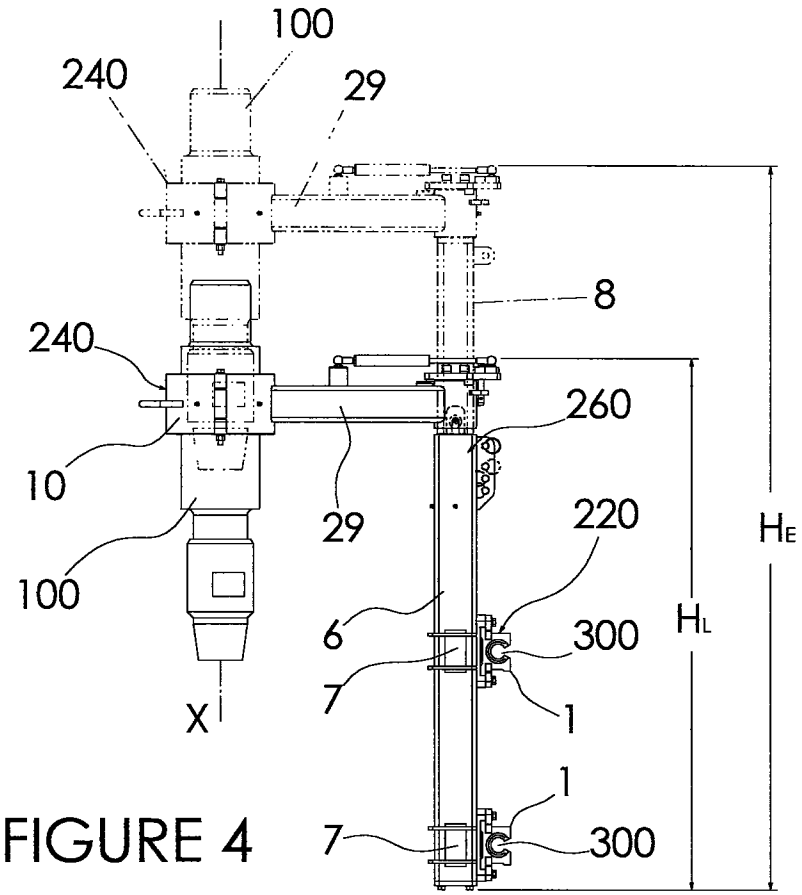
FIG. 4 is a side elevation showing movement of the main mount tube.

A gas spring 2 is provided as a movement control mechanism, to control relative movement of the tubes 6, 8. The gas spring may bias the tubes 6, 8 into an extended position, for example at a maximum extended height $H_E$. The gas spring bias urges the main mount tube into an elevated position such that it can be swung over hole center in a position above the stump and then a force can be applied to lower the apparatus to a lower height $H_L$, to and thereby allows safety valve 100 to be threaded into the stump. In FIG. 4, the elevated position is shown in phantom while the lower position is shown in solid lines. The force is sufficient to force gas spring 2 to compress and thereby shorten the main mount tube and lower the swing arm.

Figure 3:
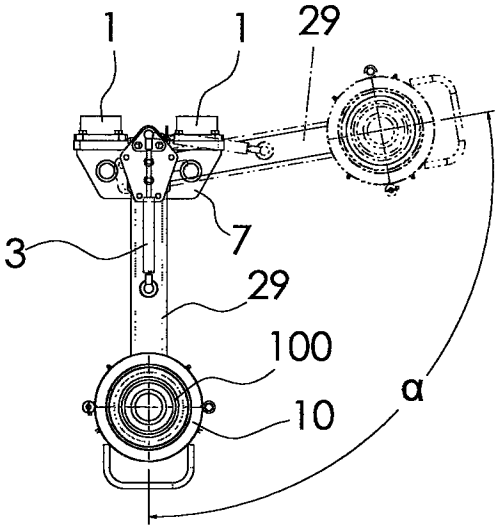
FIG. 3 is a top view showing movement of the swing arm.

As shown in FIG. 3, arm 260 also includes a swing arm 29 extending at substantially a right angle from the long axis of the main mount tube. Swing arm 29 is configured to rotate through an angle $\alpha$ relative to the long axis of the mount tube. The swing arm is connected to inner support tube 8 via a pivotal connection 30.

A gas spring 3 is provided to control movement of the swing arm through angle x relative to the mount tube. Gas spring 3 may, for example, resist uncontrolled movement of swing arm 29 such as when it is placed in slant. For example, gas spring 3 acts like a releasable position lock and may be selected to ease movement into well center and to resist movement of the swing arm from swinging uncontrollably with gravity when the mount tube is moved out of a vertical orientation.

The clamp 240 is configured to both hold the safety valve on the arm and to permit rotation of the safety valve about its long axis x. Clamp 240 may include for example a clamping portion 10 that encircles the safety valve body and a bearing 13 that is rotatable within clamping portion and thereby permits safety valve 100 to rotate within portion 10.

In the illustrated embodiment, clamping portion 10 is a split clamp with halves connected at one side by a hinge 18 and releasably connected at the other side by a releasable lock such as including a removable lock pin 5 securable through alignable barrels.

In the illustrated embodiment, bearing 13 includes a split bushing securable by, for example, fasteners 26 about the safety valve. The ring is rigidly secured about surface 112, but fits, is axially fixed and can rotate within an annular groove formed on the inside of portion 10, when its halves are secured about the ring. The annular groove is formed by a groove portion 9 on the interior surface of each half of the clamping portion.

The function of the stabbing valve apparatus is to hold safety valve 100 adjacent well center and to be movable and adjustable such that the safety valve can be moved from a storage position into a position over, for example, with a concentric center point of clamping portion 10 aligned with well center. The apparatus allows a person to secure the well by lowering the safety valve into a stump and manually tightening the connection between end 114 and the stumps threaded box connection. When threading the safety valve into the stump, the safety valve remains supported on the apparatus, but the safety valve can be rotated within the clamp of the apparatus, by rotating the ring of bearing 13 within the annular recess 9 within the clamping portion 10.

The clamp allows for quick changes of safety valves but when made up holds the safety valves securely but while allowing for rotation of the safety valve for threading.

The apparatus mounts to the rig structure 300, for example, through a torque wrench frame. The mount tube permits vertical positioning and the swing arm permits rotational positioning with controls by releasable locks such as gas springs. Thus, the apparatus can be moved and maintained in a storage position away from well center but then can be moved and adjusted readily to move the safety valve into well center and may be threaded into a stump regardless of the height of the stump or whether the rig is vertical or on a slant.

The apparatus provides a reliable, easy and relatively safe option for storing, handling and threading a safety valve into a stump to secure the well.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more."

All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or "step for."

The embodiments of the invention in which an exclusive property or privilege is claimed are defined as follows:

1. A safety valve handling apparatus for a rig, the apparatus comprising:

a mounting structure for connection to the rig;

a clamp for engaging a safety valve and configured to permit rotation of the safety valve within the clamp while the safety valve remains engaged by the clamp; and an arm connected between the mounting structure and the clamp, the arm being moveable and adjustable to permit movement of the clamp relative to the mounting structure, the arm including a main mount tube and a swing arm extending at substantially a right angle from, and coupled to, the main mount tube, wherein the swing arm is pivotable relative to the main mount tube from a position extending to a side of the main mount tube to a position extending forwardly of the main mount tube, and a gas spring connected between the swing arm and the main mount tube, the gas spring configured as a releasable position lock and selected to ease pivotal movement of the swing arm relative to the main mount tube and to resist movement of the swing arm from swinging uncontrollably with gravity when the main mount tube is moved out of a vertical orientation.

2. The safety valve handling apparatus of claim 1 wherein the mounting structure includes a connector configured for connection onto a rig mast.

3. The safety valve handling apparatus of claim 2 wherein the connector is configured for rigid connection to the mast.

4. The safety valve handling apparatus of claim 1 wherein the clamp includes a cylindrical bearing for coupling onto an outer surface of the safety valve and a cylindrical clamping portion that encircles the bearing.

5. The safety valve handling apparatus of claim 1 wherein the main mount tube is height adjustable.

6. The safety valve handling apparatus of claim 5 further comprising a movement control mechanism on the main mount tube for releasably selecting the height.

7. The safety valve handling apparatus of claim 6 wherein the movement control mechanism biases the main mount tube into a telescopically extended position for a maximum height.

8. The safety valve handling apparatus of claim 7 wherein the movement control mechanism is a second gas spring.

9. A well operation rig comprising:

a mast, configurable in a slant position;

a safety valve for securing in a stump secured by the well operation rig;

a safety valve apparatus for installing the safety valve on the mast, the safety valve comprising:

a mounting structure for connecting the apparatus to the mast;

a clamp for engaging the safety valve and configured to permit rotation of the safety valve within the clamp while the safety valve remains engaged by the clamp; and an arm, including a main mount tube and a swing arm extending at substantially a right angle from, and coupled to, the main mount tube, wherein the swing arm is pivotable relative to the main mount tube from a position extending to a side of the main mount tube to a position extending forwardly of the main mount tube, connected between the mounting structure and the clamp, the arm being moveable and adjustable to permit movement of the clamp relative to the mounting structure, the arm including a gas spring configured as a releasable position lock and selected to ease pivotal movement of the swing arm relative to the main mount tube and to resist movement of the swing arm from swinging uncontrollably with gravity when the main mount tube is moved out of a vertical orientation.

10. The well operation rig of claim 9, wherein the mounting structure includes a connector configured for connection onto a rig mast and wherein the connector is configured for rigid connection of the main mount tube to the mast in a position extending substantially parallel to the mast.

11. The well operation rig of claim 10 further comprising a movement control mechanism on the main mount tube for releasably selecting the height.

12. The well operation rig of claim 11 wherein the movement control mechanism biases the main mount tube into a telescopically extended position for a maximum height.

13. The well operation rig of claim 12 wherein the movement control mechanism is a second gas spring.

14. The well operation rig of claim 9 wherein the clamp includes a cylindrical bearing for coupling onto an outer surface of the safety valve and a cylindrical clamping portion that encircles the bearing.

* * * * *